US007956834B2

(12) United States Patent
Kang

(10) Patent No.: US 7,956,834 B2
(45) Date of Patent: Jun. 7, 2011

(54) METHOD FOR DRIVING LIQUID CRYSTAL DISPLAY AND APPARATUS EMPLOYING THE SAME

(75) Inventor: Ki-hyung Kang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 707 days.

(21) Appl. No.: 11/522,353

(22) Filed: Sep. 18, 2006

(65) Prior Publication Data

US 2007/0063947 A1 Mar. 22, 2007

(30) Foreign Application Priority Data

Sep. 16, 2005 (KR) ..... 10-2005-0087000

(51) Int. Cl.
*G09G 3/36* (2006.01)

(52) U.S. Cl. ..... 345/89; 345/690

(58) Field of Classification Search ..... 345/89, 345/55, 56, 60, 63, 87, 90, 204, 205, 214, 345/690, 691, 694; 348/699
See application file for complete search history.

(56) References Cited

U.S. PATENT DOCUMENTS

| | | | | |
|---|---|---|---|---|
| 5,119,084 | A | 6/1992 | Kawamura et al. | |
| 2002/0030652 | A1* | 3/2002 | Shibata et al. | 345/87 |
| 2004/0012551 | A1* | 1/2004 | Ishii | 345/87 |
| 2004/0233157 | A1* | 11/2004 | Sekiya et al. | 345/156 |
| 2005/0001802 | A1* | 1/2005 | Lee | 345/89 |
| 2005/0030302 | A1* | 2/2005 | Nishi et al. | 345/204 |
| 2005/0280641 | A1* | 12/2005 | Kobayashi | 345/204 |
| 2006/0072664 | A1* | 4/2006 | Kwon et al. | 375/240.16 |
| 2006/0197732 | A1* | 9/2006 | Oyaizu et al. | 345/99 |
| 2006/0284897 | A1* | 12/2006 | Shen et al. | 345/690 |
| 2007/0018934 | A1* | 1/2007 | Kim et al. | 345/98 |
| 2008/0279470 | A1* | 11/2008 | Warmuth et al. | 382/255 |

FOREIGN PATENT DOCUMENTS

| | | | |
|---|---|---|---|
| EP | 1 494 169 | A2 | 1/2005 |
| EP | 1 521 237 | A2 | 4/2005 |
| JP | 2005-043864 | A | 2/2005 |
| KR | 10-2005-003874 | A | 1/2005 |
| KR | 10-2005-004249 | A | 1/2005 |
| KR | 10-2005-0038567 | A | 4/2005 |
| WO | WO 02/41291 | A1 | 5/2002 |
| WO | WO 03/100724 | A2 | 12/2003 |
| WO | WO 03/101086 | A2 | 12/2003 |

OTHER PUBLICATIONS

Dutch Search Report, dated Aug. 31, 2010, issued in Application No. 1032517.

Masahiro Baba "46.3: Software-Processed Edge-and Level-Adaptive Overdrive (SELAO) Method for High-Quality Motion Picture". SID International Symposium. Boston, 2005, pp. 1492-1495.

* cited by examiner

*Primary Examiner* — Amare Mengistu
*Assistant Examiner* — Dmitriy Bolotin
(74) *Attorney, Agent, or Firm* — Sughrue Mion, PLLC

(57) ABSTRACT

Provided are a method and apparatus for driving a liquid crystal display. The apparatus includes: a moving image detector which reads an input signal frame by frame and compares gray-scale data of a previous frame to gray-scale data of the current frame to detect a moving pattern; a gray-scale difference calculator which calculates a gray-scale difference in the detected pattern to discriminate the boundary of the pattern from the inside of the pattern; and an output processor that generates an over-driving voltage for over-driving pixels corresponding to the inside of the pattern and applies the over-driving voltage to pixels of liquid crystal.

11 Claims, 5 Drawing Sheets

METHOD FOR DRIVING LIQUID CRYSTAL DISPLAY AND APPARATUS EMPLOYING THE SAME

CROSS-REFERENCE TO RELATED PATENT APPLICATION

This application claims priority from Korean Patent Application No. 10-2005-0087000, filed on Sep. 16, 2005, in the Korean Intellectual Property Office, the disclosure of which is incorporated herein in its entirety by reference.

BACKGROUND OF THE INVENTION

1. Field of the Invention

The present invention relates to a liquid crystal display (LCD), and more particularly, to a method for driving an LCD and an apparatus employing the same for improving picture quality.

2. Description of the Related Art

An LCD displays images by varying the arrangement of liquid crystal molecules by the action of an electric field to control light transmissivity. Types of LCDs that have been developed include the Twisted Nematic LCD (TN-LCD), the Super-Twisted Nematic (STN-LCD), the Metal-Insulator-Metal LCD (MIM-LCD) and the Thin-film Transistor (TFT-LCD), and LCD display performance has been remarkably enhanced. The LCD comes into the spotlight as an apparatus capable of replacing a CRT because it is compact and has a low power consumption. Demands for the LCD are increasing as the LCD is applied to a wide range of applications including portable TV, notebook computers, video phones, video cameras, mobile communication devices and so on.

The LCD includes an LCD panel in which pixels are arranged in an active matrix form, a gate driver and a data driver for driving the LCD panel. The LCD panel includes a color filter substrate and a thin film transistor array substrate, which are opposite to each other, and a liquid crystal layer formed of liquid crystal filled between the color filter substrate and the thin film transistor array substrate.

Common electrodes and pixel electrodes are respectively formed on the inner sides of the color filter substrate and the thin film transistor array substrate, which face each other. When a data signal is applied to the pixel electrodes while a common voltage is applied to the common electrodes and an electric field caused by a potential difference between a pixel voltage and the common voltage is applied to the liquid crystal layer. Accordingly, a desired image can be displayed by controlling light transmissivity of the liquid crystal layer by different data signals applied to the pixel electrodes.

Data lines for transmitting a data signal supplied from the data driver to the pixel electrodes and gate lines for transmitting a high gate voltage supplied from the gate driver to the pixel electrodes are formed on the thin film transistor array substrate. The data lines intersect the gate lines and the gate lines transmit the high gate voltage to the pixel electrodes such that the pixel electrodes are sequentially selected line by line.

Thin film transistors (TFTS) used as switching elements are respectively connected to the pixel electrodes. The TFTs are turned on by the high gate voltage supplied through the gate lines and the data signal provided through the data lines is applied to the pixel electrodes through the source and drain electrodes of the TFTs, and thus the light transmissivity of the liquid crystal layer is controlled by an electric field between the common voltage applied to the common electrodes and the data signal applied to the pixel electrodes.

In the LCD, however, controlling the arrangement of liquid crystal molecules accompanies a time delay and a response speed of the liquid crystal molecules is lower than a frame change rate because of unique characteristic of the liquid crystal molecules. This blurs the contour of a moving image or deteriorates picture quality when the moving image is displayed on the LCD.

To solve this problem, previous input data and current input data are compared to each other and the LCD panel is over-driven with maximum and minimum voltages of a source driver integrated circuit to increase the response speed of the liquid crystal. However, moving images are blurred because of hold type display characteristic of the LCD. Specifically, when a motion is generated on the screen of the LCD, the eyes of a viewer follow this motion. Here, the boundary of the motion appears blurry to the viewer because a hold type display such as an LCD maintains data written once for one frame.

FIGS. 1A and 1B are graphs showing motion blur generated in a conventional LCD driving method. A gray part in a white box represents a transitional stage in which one pixel is on or off as a frame is increased. The response speed of liquid crystal becomes higher as the gray part occupies a smaller area.

FIG. 1A illustrates a case that the response speed of liquid crystal is ½ frame. In this case, motion blur appears in 4.5 pixels. FIG. lB illustrates a case that the response speed of liquid crystal is 1 frame. In this case, motion blur appears in 6 pixels. As shown in the intensity graphs located at lower parts of FIGS. 1A and 1B, the edges have the same slope even when the response speed of liquid crystal is increased, and thus blurring of the edges cannot be prevented.

Accordingly, although the conventional LCD driving method can increase the response speed of the liquid crystal to reduce the motion blur, the edges remain blurred and the picture quality is deteriorated even when the response speed of the liquid crystal is increased.

SUMMARY OF THE INVENTION

An aspect of the present invention provides a method for driving an LCD, which detects a moving pattern from a video signal and applies different driving voltages to the boundary and inside of the pattern to prevent picture quality from being deteriorated due to edge blurring generated when a moving image is displayed.

An aspect of the present invention also provides an LCD employing the LCD driving method.

According to an aspect of the present invention, there is provided a method for driving a liquid crystal display comprising: receiving data of an input signal frame by frame; comparing gray-scale data of a previous frame of the input signal to gray-scale data of the current frame of the input signal to detect a moving pattern; calculating a gray-scale difference in the detected pattern to discriminate the boundary of the pattern from the inside thereof; and generating an over-driving voltage for over-driving pixels corresponding to the inside of the pattern and applying the over-driving voltage to pixels of liquid crystal.

According to another aspect of the present invention, there is provided a computer readable recording medium storing a program executing a method for driving a liquid crystal display comprising: receiving data of an input signal frame by frame; comparing gray-scale data of a previous frame of the input signal to gray-scale data of the current frame of the input signal to detect a moving pattern; calculating a gray-scale difference in the detected pattern to discriminate the boundary of the pattern from the inside thereof; and generating an over-driving voltage for over-driving pixels corresponding to the inside of the pattern and applying the over-driving voltage to pixels of liquid crystal.

According to another aspect of the present invention, there is provided a liquid crystal display comprising: a frame memory storing data of an input signal frame by frame; a moving image detector reading previous frame data from the frame memory, reading current frame data from the input signal and comparing the previous frame data to the current frame data to detect a moving pattern; a gray-scale difference calculator calculating a gray-scale difference in the pattern detected by the moving image detector to discriminate the boundary of the pattern from the inside thereof; and an output processor generating an over-driving voltage for over-driving pixels corresponding to the inside of the pattern.

The output processor may control the over-driving voltage in consideration of the moving direction and velocity of the pattern.

The output processor may control the over-driving voltage to be lowered only for pixels placed at both edges of the moving distance of the pattern.

The output processor may control the over-driving voltage such that the over-driving voltage is decreased for pixels close to the boundary of the pattern and, when the moving velocity of the pattern is high, decrease the over-driving voltage even for pixels distant from the boundary of the pattern.

The output processor may control the over-driving voltage to be decreased for pixels close to the boundary of the pattern.

The frame memory may use a random access memory as a memory device for high-speed response.

The method for driving a liquid crystal display may further include detecting the moving direction and velocity of the detected pattern, and control the over-driving voltage in consideration of the moving direction and velocity of the pattern and apply the controlled over-driving voltage to the pixels of liquid crystal.

The over-driving voltage may be controlled to be lowered only for pixels disposed at both edges of the moving distance of the pattern.

The over-driving voltage may be controlled such that the over-driving voltage is decreased for pixels close to the boundary of the pattern and, when the moving velocity of the pattern is high, the over-driving voltage may be controlled to be decreased even for pixels distant from the boundary of the pattern.

The over-driving voltage may be controlled to be decreased for pixels close to the boundary of the pattern.

A program for executing the method for driving an LCD may be recorded on a computer readable recording medium.

BRIEF DESCRIPTION OF THE DRAWINGS

The above and other features and aspects of the present invention will become more apparent by describing in detail the non-limting exemplary embodiments thereof with reference to the attached drawings in which.

DETAILED DESCRIPTION OF THE INVENTION

Figure 1A:
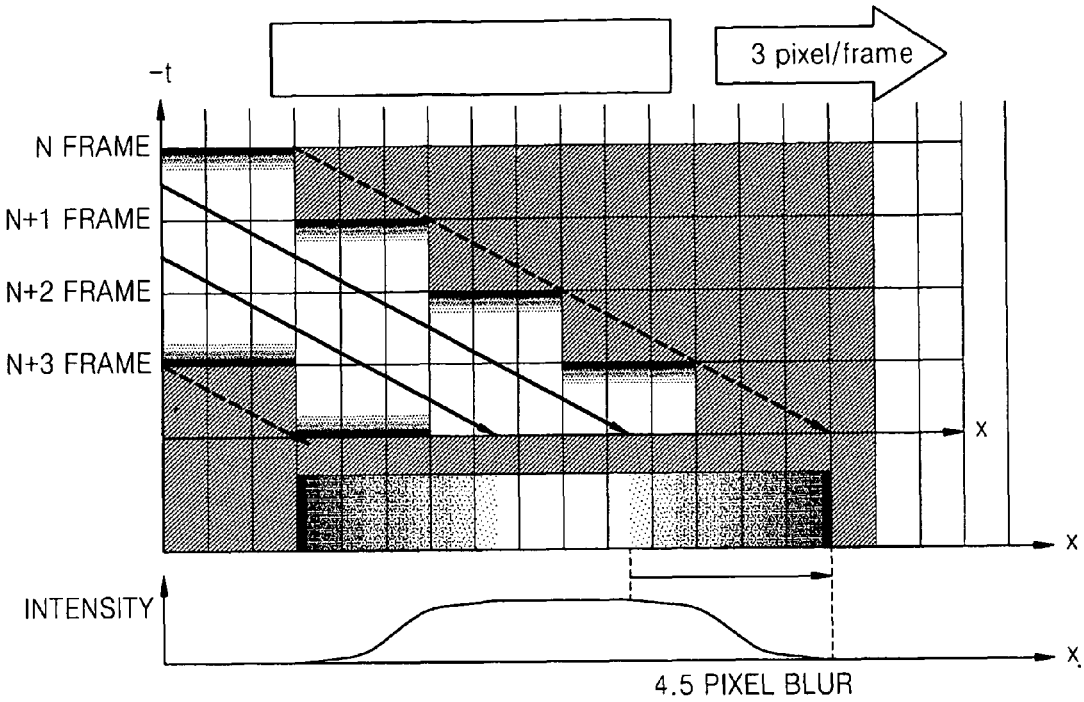
FIG. 1A (PRIOR ART)
FIGS. 1A and 1B are graphs showing motion blur generated in a conventional LCD driving method.

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. Throughout the drawings, like reference numerals refer to like elements.

Figure 2:
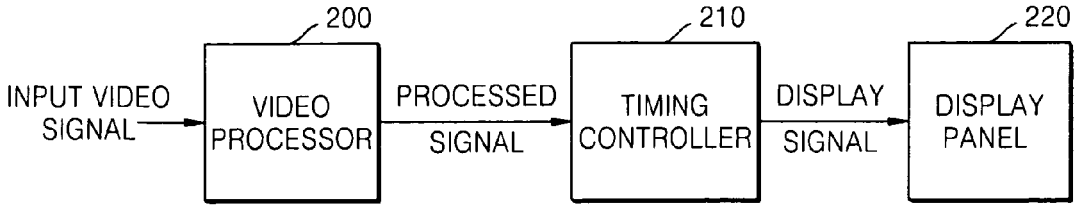
FIG. 2 is a block diagram of an LCD according to an exemplary embodiment of the present invention.

FIG. 2 is a block diagram of an LCD according to an exemplary embodiment of the present invention. A video processor 200 performs a signal process on an input video signal to convert the input video signal into a signal suitable for a display panel 220 and outputs the processed signal. A timing controller 210 controls timing of the processed signal in consideration of a response speed of the display panel 220 and transmits the processed signal to the display panel 220. The timing controller 210 converts the processed signal into a display signal that is a voltage signal to be applied to pixels. The display panel 220 includes a plurality of pixels and displays an image corresponding to the received display signal.

Figure 3:
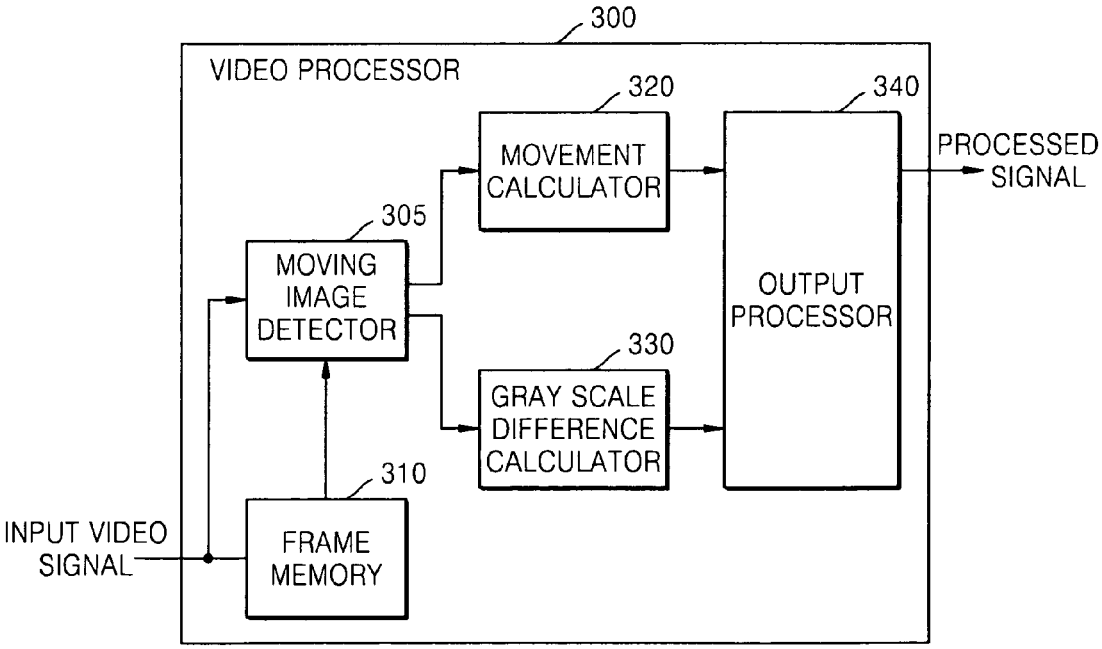
FIG. 3 is a block diagram of a video processor of the LCD according to an exemplary embodiment of the present invention.

FIG. 3 is a block diagram of a video processor 300 according to an exemplary embodiment of the present invention. A moving image detector 305 compares the current frame data of an input video signal to previous frame data stored in a frame memory 310 to detect a moving pattern. The moving image detector 305 can respectively read the previous frame data and the current frame data from the frame memory 310 and the input video signal and compare gray-scale data of the previous frame to gray-scale data of the current frame to detect the moving pattern. The moving pattern can be detected using a motion vector.

The frame memory 310 stores data of previous frames of the input video signal. The frame memory 310 is a memory device for high-speed response and can be a random access memory (RAM).

A movement calculator 320 calculates the moving direction and velocity of the moving pattern detected by the moving image detector. A gray-scale difference calculator 330 analyzes a gray-scale difference in the moving pattern detected by the moving image detector to discriminate the inside of the pattern from the boundary thereof. The inside and boundary of the pattern are discriminated from each other using the fact that there is a large gray-scale difference between the inside and boundary of the pattern.

An output processor 340 generates an over-driving voltage in consideration of the moving direction and velocity of the pattern, calculated by the movement calculator 320. The over-driving voltage is higher than a normal driving applied to the pixels in order to increase the response speed of liquid crystal. In addition, the output processor 340 controls the over-driving voltage such that higher voltage is applied to pixels more distant from the boundary of the pattern.

The output processor 340 may generate the over-driving voltage for pixels corresponding to the inside of the pattern, and then control the over-driving voltage in consideration of the moving direction and velocity of the pattern. Particularly, the output processor 340 can control the over-driving voltage to be lowered only for pixels disposed at both edges of the moving distance of the pattern.

Furthermore, the output processor 340 controls the over-driving voltage to be decreased for the pixels close to the boundary of the pattern and, when the moving velocity of the pattern is high, controls the over-driving voltage to be lowered even for pixels distant from the boundary of the pattern.

The process of controlling driving voltages in consideration of the movinsented as follows.

$$V'=V\times(1+W\times(\Delta X_{max}/2-\Delta X)) \quad \text{[Equation 1]}$$

where V' and V, which are voltages applied to specific pixels, represent a voltage to which a weight in response to a velocity is applied and a voltage to which a weight is not applied, respectively. W is a weight constant, $\Delta X_{max}$ is a moving distance of a specific pixel between frames, and $\Delta X$ is a distance between the boundary of a previous frame and the specific pixel. V' is equal to V when $\Delta X$ becomes $\Delta X_{max}/2$ and becomes a maximum over-driving voltage (or maximum value) when $\Delta X$ is 1. V' becomes a voltage (or minimum voltage) smaller than V when $\Delta X$ is equal to $\Delta X_{max}$.

The purpose of controlling the over-driving voltage in consideration of the moving direction and velocity of the pattern is to make the boundary of the pattern be seen more distinctly using the human visual characteristic that integrates the gray scale of the boundary along the moving direction of the pattern to recognize the boundary.

The over-driving voltage generated by the output processor 340 is output as a display signal and applied to the pixels of the display panel.

Figure 4A:
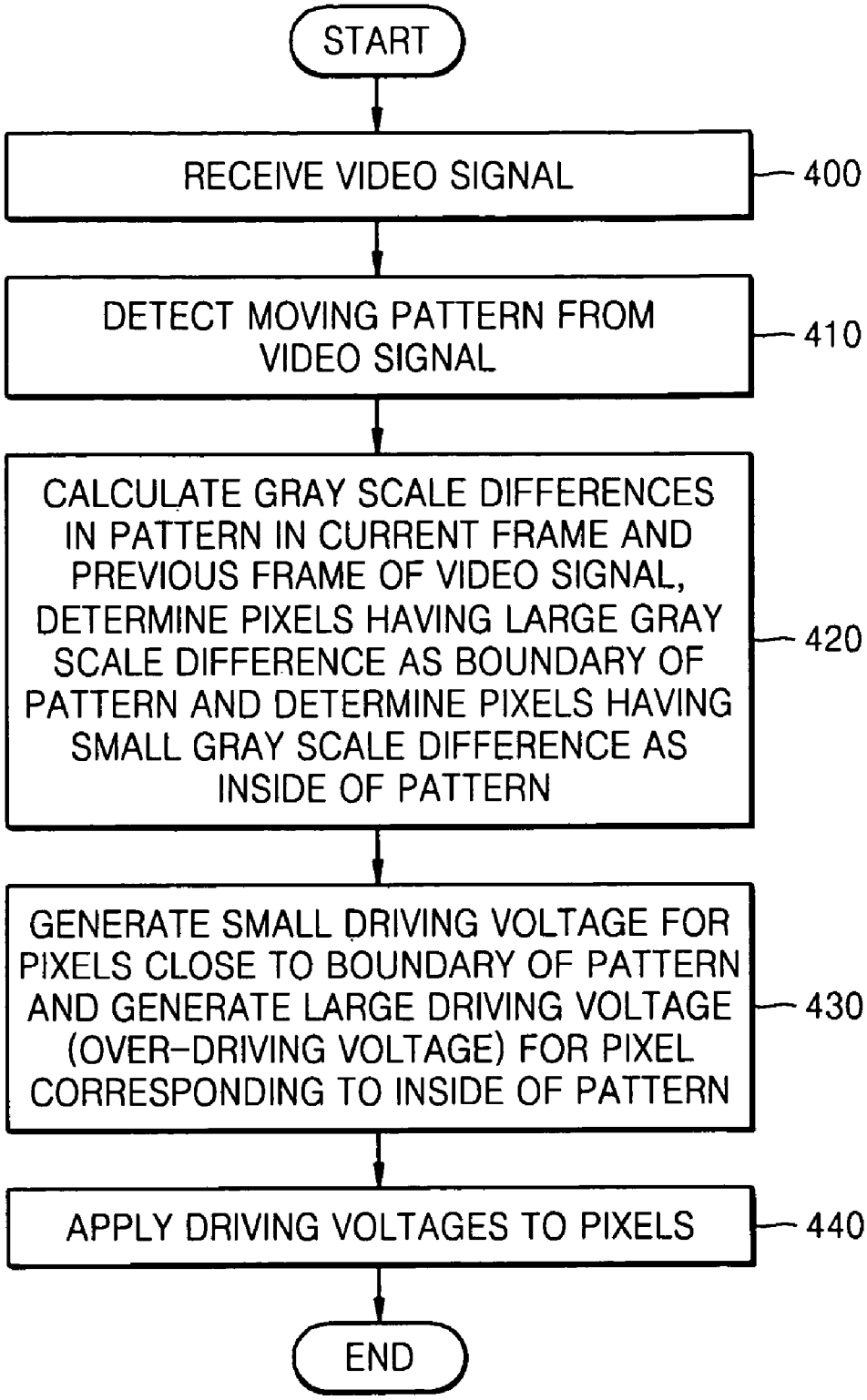
FIG. 4A is a flow chart showing a method for driving an LCD according to an exemplary embodiment of the present invention.

FIG. 4A is a flow chart showing a method for driving an LCD according to an exemplary embodiment of the present invention. Referring to FIG. 4A, a video signal is input in step 400. Specifically, the video signal is input to a display device such as an LCD through a signal processor such as a graphic card. A moving pattern is detected from the input video signal in step 410. Specifically, gray-scale data of a previous frame is compared to gray-scale data of the current frame to detect whether a specific pattern is moving. The pattern can be detected using a motion vector.

When the pattern is detected, the boundary and inside of the pattern are discriminated from each other in step 420. The discrimination of the boundary of the pattern from the inside thereof can be performed by calculating gray-scale differences in the pattern in the current frame and previous frame of the video signal and determining pixels having a large gray-scale difference as the boundary of the pattern and determining pixels having a small gray-scale difference as the inside of the pattern. Otherwise, the boundary and inside of the pattern can be discriminated from each other using a difference between the gray scale of the boundary of the pattern and the gray scale of the inside of the pattern.

When the boundary of the pattern is discriminated from the inside thereof, a small driving voltage is generated for pixels close to the boundary of the pattern and a large driving voltage, that is, the over-driving voltage, is generated for pixels corresponding to the inside of the pattern in step 430. The over-driving voltage is higher than a normal driving voltage applied to pixels of liquid crystal in order to increase the response speed of the liquid crystal.

Finally, the generated driving voltages are applied to the pixels of the LCD panel in step 440. The driving voltages are transmitted to the pixels through the display signal.

Figure 4B:
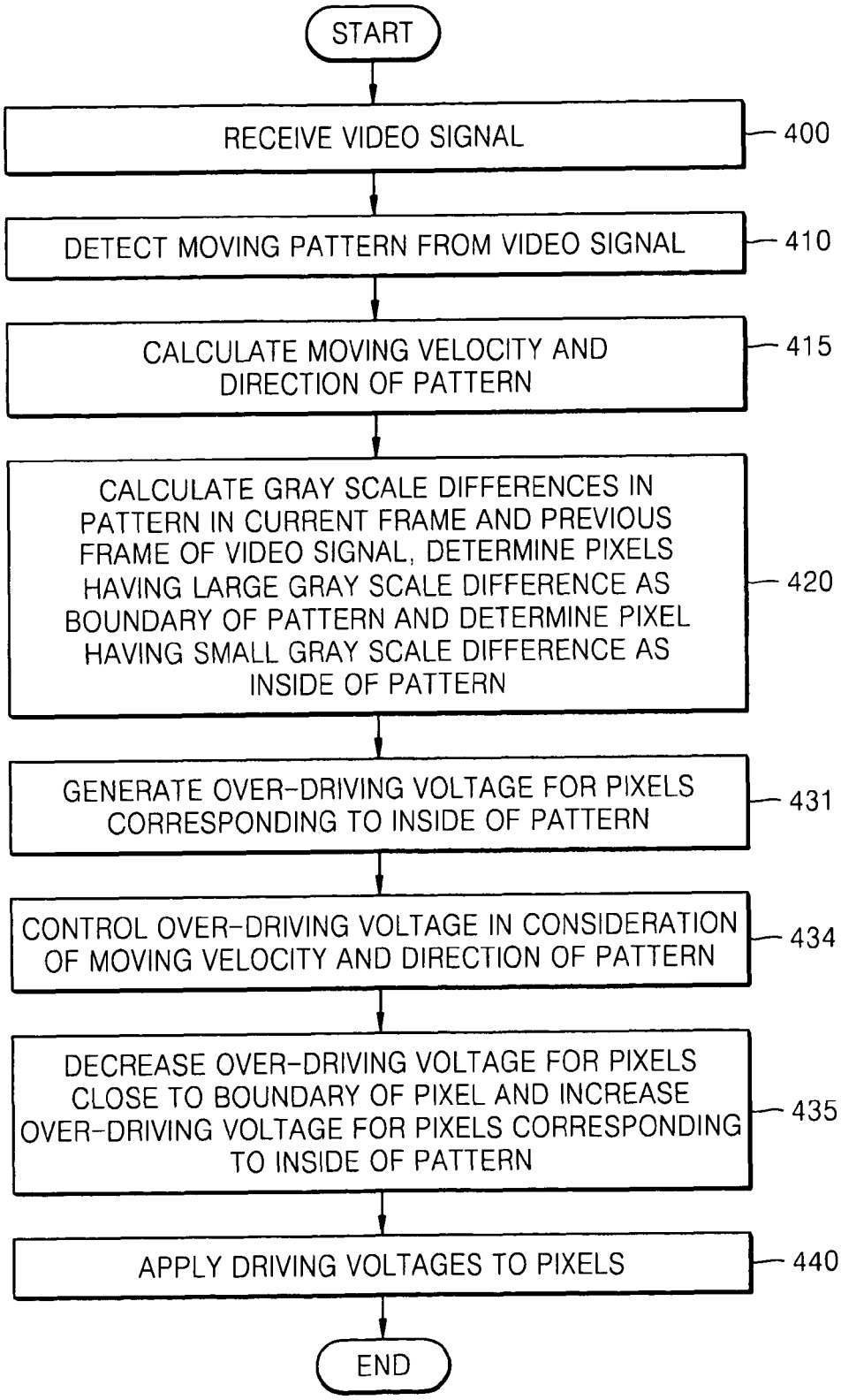
FIG. 4B is a flow chart showing the method for driving an LCD according to an exemplary embodiment of the present invention in more detail.

FIG. 4B is a flow chart showing the method for driving an LCD according to an exemplary embodiment of the present invent in more detail. Referring to FIG. 4B, the video signal is input to a display device such as an LCD through a signal processor such as a graphic card in step 400. A moving pattern is detected from the input video signal in step 410. Specifically, gray-scale data of a previous frame is compared to gray-scale data of the current frame to detect whether a specific pattern is moving. The pattern can be detected using a motion vector.

When the pattern is detected, the moving velocity and direction of the pattern are calculated in step 415. The moving velocity and direction of the pattern can be obtained by comparing data (gray-scale data) of the current frame to data (gray-scale data) of the previous frame or by using the size and direction of a motion vector.

The boundary and inside of the pattern are discriminated from each other in order to make the boundary of a moving image to be displayed distinct in step 420. The discrimination of the boundary of the pattern from the inside thereof can be performed by calculating gray-scale differences in the pattern in the current frame and previous frame of the video signal and determining pixels having a large gray-scale difference as the boundary of the pattern and determining pixels having a small gray-scale difference as the inside of the pattern. Otherwise, the boundary and inside of the pattern can be discriminated from each other using a difference between the gray scale of the boundary of the pattern and the gray scale of the inside of the pattern.

Then, the over-driving voltage is generated for pixels corresponding to the inside of the pattern in step 431. The over-driving voltage is higher than a normal driving voltage applied to pixels of liquid crystal in order to increase the response speed of the liquid crystal.

The driving voltages are controlled for respective pixels in consideration of the moving velocity and direction of the pattern in step 434. Here, the over-driving voltage is controlled to be lowered only for pixels disposed at both edges of the moving distance of the pattern. That is, when the pattern is moved on the X-axis of a picture, the over-driving voltage is not controlled for pixels on the Y-axis.

The over-driving voltage is controlled such that the over-driving voltage is decreased for pixels close to the boundary of the pattern. When the moving velocity of the pattern is high, the over-driving voltage is controlled to be lowered even for pixels distant from the boundary of the pattern. For example, the over-driving voltage is decreased for one pixel from the boundary of the pattern when the pattern is moved by 3 pixels for one frame and for 2 pixels from the boundary of the pattern when the pattern is moved by 5 pixels for one frame.

When the driving voltages are generated for the respective pixels, the driving voltages are decreased for pixels close to the boundary of the pattern and increased for pixels corresponding to the inside of the pattern in step 435.

Finally, the generated driving voltages are applied to the pixels of the LCD panel in step 440. The driving voltages are transmitted to the pixels through the display signal.

Accordingly, a gray-scale difference between the boundary and inside of the pattern becomes large (the slope of the edge becomes sharp in the intensity graph) to minimize boundary burring when the pattern is moved.

Figure 5:
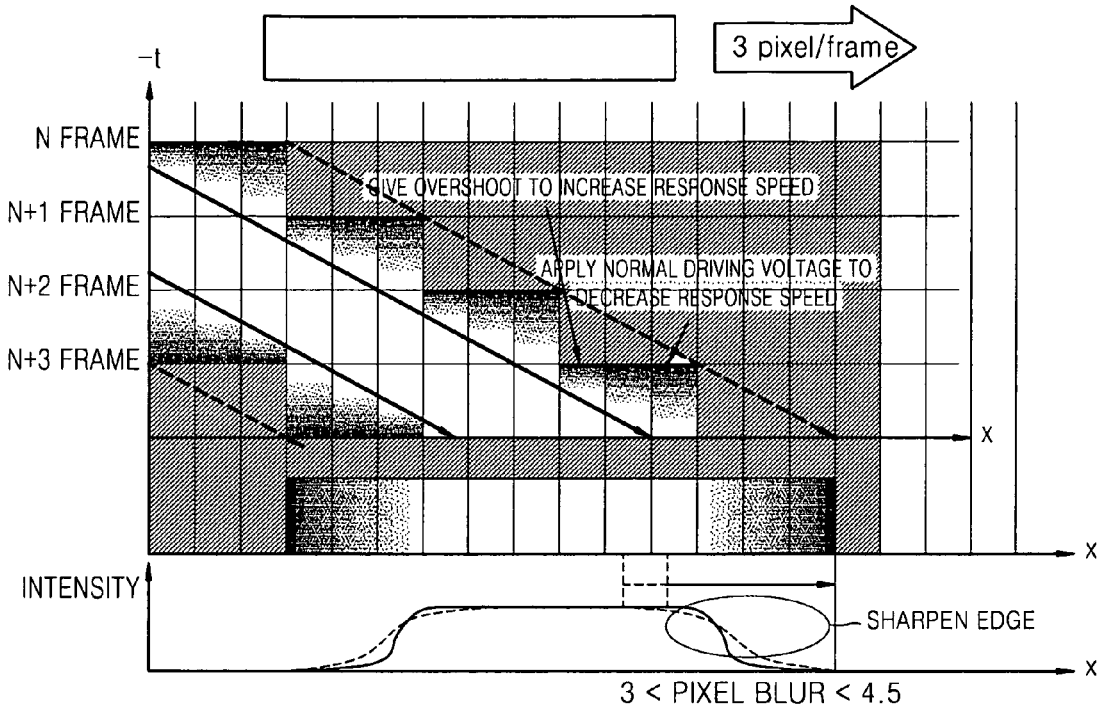
FIG. 5 is a graph showing the result obtained by applying the method for driving an LCD according to an exemplary embodiment of the present invention to an LCD.

FIG. 5 is a graph showing the result obtained by applying the method for driving an LCD to an LCD. In FIG. 5, a gray part in a white box represents a transitional stage in which one pixel is on or off as a frame is increased. That is, the response speed of liquid crystal increases as the gray part occupies a smaller area. Referring to FIG. 5, pixels coming into contact with a black background have a low response speed and pixels distant from the black background have a high response speed. That is, FIG. 5 shows that a normal driving voltage or less is applied to pixels at the boundary and the over-driving voltage higher than the normal driving voltage is applied to pixels distant from the boundary. In this manner, different driving voltages are applied to the pixels corresponding to the boundary of the pattern and the pixels corresponding to the inside of the pattern to make the boundary more distinct.

Figure 1B:
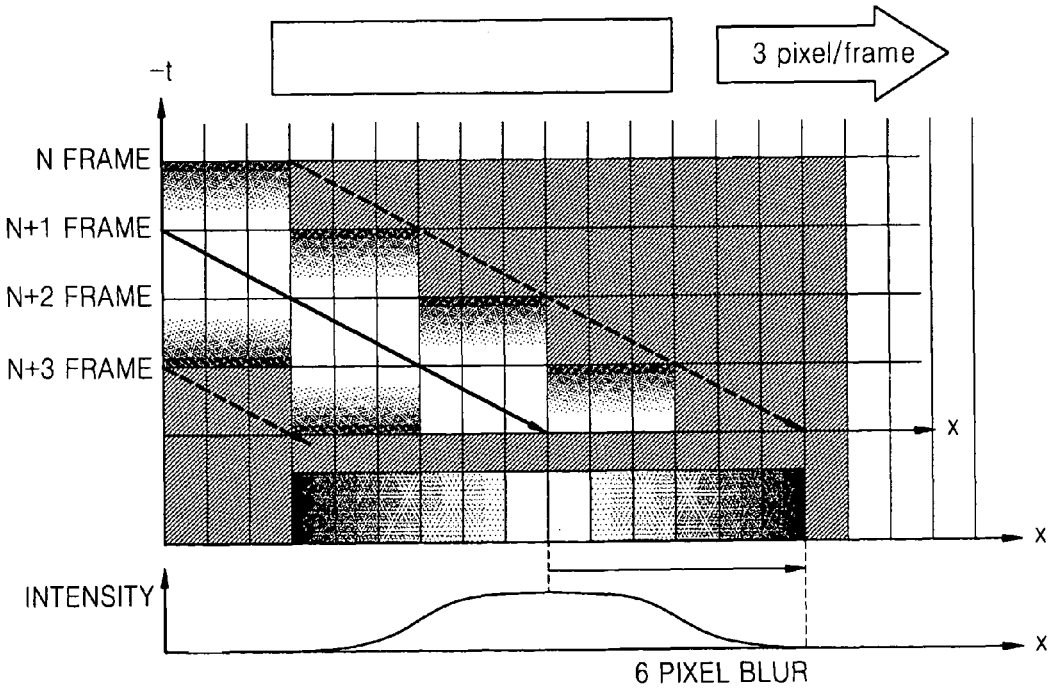
FIG. 1B (PRIOR ART)

FIG. 5 shows that the white box is moved by three pixels for each frame on the black background. Distinguished from FIGS. 1A and 1B, the edge of the intensity graph of FIG. 5 becomes sharp, and thus the boundary of the white box is distinctly seen. That is, motion blur in the upper graph of FIG. 5 is reduced within 4.5 pixels to improve picture quality when a moving image is displayed.

The rectangular pattern, that is, the white box, is an example and there may be various patterns.

As described above, the present invention detects a moving pattern from a video signal, applies a small driving voltage to pixels corresponding to the boundary of the pattern and applies the over-driving voltage to pixels corresponding to the inside of the pattern to prevent the boundary of the pattern from being blurred, thereby improving picture quality. Furthermore, the present invention can provide a high quality image having a distinct boundary and minimized blurring.

The output processor of the present invention may control the over-driving voltage in consideration of the moving direction and velocity of the pattern.

The output processor of the present invention may control the over-driving voltage to be lowered only for pixels placed at both edges of the moving distance of the pattern.

The output processor of the present invention may control the over-driving voltage such that the over-driving voltage is decreased for pixels close to the boundary of the pattern and, when the moving velocity of the pattern is high, decrease the over-driving voltage even for pixels distant from the boundary of the pattern.

The output processor of the present invention may control the over-driving voltage to be decreased for pixels close to the boundary of the pattern.

The frame memory of the present invention may use a random access memory as a memory device for high-speed response.

The present invention may include a step of detecting the moving direction and velocity of the detected pattern, control the over-driving voltage in consideration of the moving direction and velocity of the pattern and apply the controlled over-driving voltage to the pixels of liquid crystal.

The present invention may control the over-driving voltage to be lowered only for pixels disposed at both edges of the moving distance of the pattern.

The present invention may control the over-driving voltage such that the over-driving voltage is decreased for pixels close to the boundary of the pattern and, when the moving velocity of the pattern is high, control the over-driving voltage to be decreased even for pixels distant from the boundary of the pattern.

The present invention may control the over-driving voltage to be decreased for pixels close to the boundary of the pattern.

A program for executing the method for driving an LCD according to the present invention can be recorded on a computer readable recording medium.

The present invention can be executed through software. In this case, components of the present invention are code segments executing required operations. Programs or code segments can be stored in a processor readable medium or transmitted through a computer data signal combined with a carrier in a transmission medium or a communication network.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display comprising:

a moving image detector which reads previous frame data from a frame memory, reads current frame data from an input signal and compares the previous frame data to the current frame data to detect a moving pattern;

a gray-scale difference calculator which calculates a gray-scale difference in the moving pattern detected by the moving image detector to discriminate a boundary of the moving pattern from an inside of the moving pattern; and an output processor which generates an over-driving voltage for over-driving pixels corresponding to pixels inside the moving pattern, and concurrently controls the over-driving voltage of the pixels corresponding to pixels inside the moving pattern, so as to be decreased for pixels close to a boundary of the moving pattern and to be increased for pixels distant from the boundary of the moving pattern, wherein the controlled over-driving voltage is a voltage applied to a corresponding pixel which is higher than a normal voltage applied to the corresponding pixel.

2. The liquid crystal display of claim 1, further comprising a movement calculator which calculates a moving direction and a velocity of the moving pattern detected by the moving image detector and transmits the moving direction and the velocity to the output processor, the output processor controls the over-driving voltage in consideration of the moving direction and the velocity of the moving pattern.

3. The liquid crystal display of claim 2, wherein the output processor controls the over-driving voltage to be lowered only for pixels disposed at both edges of a moving distance of the moving pattern.

4. The liquid crystal display of claim 2, wherein the output processor controls the over-driving voltage such that the over-driving voltage is decreased for pixels close to the boundary of the moving pattern and, when the moving velocity of the pattern is high, decreases the over-driving voltage even for pixels distant from the boundary of the pattern.

5. The liquid crystal display of claim 1, wherein the frame memory uses a random access memory as a memory device for high-speed response.

6. A method for driving a liquid crystal display comprising:

receiving data of an input signal frame by frame;

comparing gray-scale data of a previous frame of the input signal to gray-scale data of the current frame of the input signal to detect a moving pattern;

calculating a gray-scale difference in the detected moving pattern to discriminate a boundary of the moving pattern from the inside of the moving pattern;

generating an over-driving voltage for over-driving pixels corresponding to pixels inside the moving pattern;

controlling, concurrently, the over-driving voltage of the pixels corresponding to pixels inside the moving pattern, so as to be decreased for pixels close to a boundary of the moving pattern and to be increased for pixels distant from the boundary of the moving pattern; and applying the controlled over-driving voltage to the pixels of the moving pattern, wherein the controlled over-driving voltage is a voltage applied to a corresponding pixel which is higher than a normal voltage applied to the corresponding pixel.

7. The method of claim 6, wherein the discriminating the boundary of the pattern from the inside of the moving pattern comprises detecting a moving direction and a velocity of the moving pattern, and the generating the over-driving voltage and applying the over-driving voltage to the pixels comprises controlling the over-driving voltage in consideration of the moving direction and the velocity of the moving pattern and applying the controlled over-driving voltage to the pixels.

8. The method of claim 7, wherein the generating the over-driving voltage and applying the over-driving voltage to the pixels comprises controlling the over-driving voltage to be lowered only for the pixels disposed at both edges of a moving distance of the moving pattern.

9. The method of claim 7, wherein the generating the over-driving voltage and applying the over-driving voltage to the pixels comprises controlling the over-driving voltage such that the over-driving voltage is decreased for pixels close to the boundary of the moving pattern and, when the moving velocity of the moving pattern is high, controlling the over-driving voltage to be decreased for pixels distant from the boundary of the moving pattern.

10. A non-transitory computer readable recording medium storing a program executing the method of claim 6 on a computer.

11. A non-transitory computer readable recording medium storing a program executing the method of claim 7 on a computer.

* * * * *